US010986886B2

(12) United States Patent
Willows et al.

(10) Patent No.: US 10,986,886 B2
(45) Date of Patent: Apr. 27, 2021

(54) STRETCH BELT WITH POCKETS

(71) Applicant: Amphipod, Inc., Seattle, WA (US)

(72) Inventors: Keith S. Willows, Seattle, WA (US); June A. Angus, Seattle, WA (US); Antonio Del Rosario, Bellevue, WA (US)

(73) Assignee: Amphipod, Inc., Seattle, WA (US)

( * ) Notice: Subject to any disclaimer, the term of this patent is extended or adjusted under 35 U.S.C. 154(b) by 64 days.

(21) Appl. No.: 16/252,470

(22) Filed: Jan. 18, 2019

(65) Prior Publication Data

US 2019/0223530 A1 Jul. 25, 2019

Related U.S. Application Data

(60) Provisional application No. 62/709,609, filed on Jan. 22, 2018.

(51) Int. Cl.
*A41F 9/00* (2006.01)

(52) U.S. Cl.
CPC ..... *A41F 9/002* (2013.01)

(58) Field of Classification Search
CPC .. A41F 9/002; A41F 9/00; A41F 9/025; A45F 3/005; A45C 1/04; A41D 2200/10; A41D 27/205; A41D 27/20
USPC ..... 2/338, 253
See application file for complete search history.

(56) References Cited

U.S. PATENT DOCUMENTS 1,618,039 A * 2/1927 Ader ..... A41D 27/20 2/247
4,501,028 A * 2/1985 Gottschall ..... A41F 9/002 2/338
4,525,879 A * 7/1985 Kalomeris ..... A45C 1/04 2/247
6,311,336 B1 * 11/2001 Gootrad ..... A41D 27/208 2/251
8,628,488 B2 * 1/2014 Serola ..... A61B 17/1325 128/846
D746,051 S * 12/2015 Conway ..... D3/226
2006/0261107 A1 * 11/2006 Daniels ..... A45F 5/00 224/219
2009/0300818 A1 * 12/2009 Waite ..... A41D 1/14 2/76
2013/0061370 A1 * 3/2013 Ezell ..... A41D 23/00 2/207
2015/0282532 A1 * 10/2015 Geymayr ..... A41C 1/10 450/150
2015/0366280 A1 * 12/2015 Fay ..... F41C 33/048 2/311
2016/0066679 A1 * 3/2016 Capps ..... A45F 3/14 224/660

(Continued)

FOREIGN PATENT DOCUMENTS

DE 3710163 A1 * 10/1988 ..... A41F 9/002

*Primary Examiner* — Alissa L Hoey
*Assistant Examiner* — Patrick J. Lynch
(74) *Attorney, Agent, or Firm* — Lowe Graham Jones PLLC

(57) ABSTRACT

A belt winch may be formed from stretchy fabric, includes a front panel joined to a rear panel. Flaps may be provided to form interior pockets, which are further formed by stitching or other joining techniques. Internal stiffening and resilient members may be incorporated between the panels at each end, aiding in the structure of the opposing ends of the belt which tie together.

13 Claims, 15 Drawing Sheets

(56) References Cited

U.S. PATENT DOCUMENTS

| | | | | |
|---|---|---|---|---|
| 2019/0003113 | A1* | 1/2019 | Altman | D06M 15/15 |
| 2019/0223530 | A1* | 7/2019 | Willows | A45C 13/103 |

* cited by examiner

STRETCH BELT WITH POCKETS

PRIORITY CLAIM

This application claims the benefit of U.S. provisional application No. 62/709,609 filed Jan. 22, 2018, the contents of which are incorporated by reference.

BACKGROUND OF THE INVENTION

While engaging in sports like running, biking, walking and many other outdoor and leisure activities it is often desirable to bring personal items such as phones, cards, money, medication, personal medical devices, sunglasses, eye drops, or other items a person may need. The nature of the clothing suitable for such activities, and sometimes the activities themselves, often make it difficult to carry such items easily.

SUMMARY OF THE INVENTION

The preferred version of the invention includes a belt configured to be tied about the waist of a user.

In one version, the belt is reversible and may provide a user with two options for the outwardly facing fabric which gives the user the ability to choose different patterns, colors and textures that can be coordinated with a user's particular needs/aesthetics. Further, because the belt is able to be worn in a reversible manner, a user does not need to worry about which side goes in or out, making the belt simple to wear and use.

One version preferably has integrated pockets, and in many applications three separated pockets are desirable. Most preferably it includes three separated pockets, with a main central pocket having an invisible zipper closure and two side pockets with simple open top openings. In other versions the belt includes more or fewer pockets and additional zippers or closures for the separate pockets.

The pockets are preferably integrated and configured in which a central pocket incorporates a zipper closure. The central zipper is preferably a hidden style zipper and formed from non-stretch materials such dial the stretch of the belt material thereby is locally constrained. Locally constraining the stretch of the belt can provide for a more bounce-controlled feel when objects (like cell phones and other personal items) are carried in the belt's pockets by the user.

In one version, the belt is fabricated from stretch material of a desired weight and thickness, such that it conforms to a user's body. At the same time, the belt is preferably constructed in such a manner to control and limit stretch in certain areas as while allowing stretch in others such that comfort and bounce-free stability can be attained when a user places items such as cell phones, keys, inhalers, or sunscreen, in the pockets. The stretch material can further facilitate tying the belt to itself in a secure and repeatable fashion, allowing it to be easily knotted and unknotted by a user such that the knot does not slip when the weight of carried items is applied, yet can be knotted and unknotted by a user without difficulty.

Most preferably, the belt is fabricated in such a manner that it ties to a user's waist (or can be worn in other ways such as a sash) allowing a user to tie the belt as loosely or as tightly as desired and further accommodating different body sizes and dimensions.

The belt preferably incorporates no buckles or clasps and a user simply ties the belt to the waist, knotting it to itself as a belt or a sash. In an alternate configuration, two belts can be crossed in a sash/bandolier manner.

In one version, the belt is made from a stretchy but also breathable material (such as stretch nylon with spandex and/or polyester with spandex). Most preferably, the belt material has a thickness between 0.25 mm and 0.75 mm, or between 0.35 mm and 0.65 mm thick, and with 0.5 mm being an optimal thickness in many cases. The preferable weight of the fabric is between 250 grams per yard and 500 grams per yard (when 58" wide stock material is used). For most applications the material used for the belt is a breathable fabric but in some cases areas, portions or all of the belt could be made from water resistant or waterproof materials, or incorporate a water resistant or waterproof layer or membrane such that the belt provides a level of protection for the contents of the pockets.

BRIEF DESCRIPTION OF THE DRAWINGS

Preferred and alternative examples of the present invention are described in detail below with reference to the following drawings.

In the sectional views shown, in order for the clarity of the sectional views to be enhanced, the thickness of the material is exaggerated such that section lines can be seen and structure of construction can be more easily understood.

FIG. 23 is a sectional view of a portion (enlarged to show detail) of an alternate embodiment of a belt taken through section H-H in FIG. 22. Material thickness is exaggerated for clarity.

FIG. 24 is a sectional view of a portion (enlarged to show detail) of a third embodiment of a belt taken through section H-H in FIG. 22.

FIG. 25 is a sectional view (enlarged to show detail) of a further embodiment of a stretch belt taken through section H-H in FIG. 22.

FIG. 34 is a sectional view of a portion (enlarged to show detail) of the embodiment of a belt taken through section M-M in FIG. 32.

FIG. 35 is a sectional view of a portion (enlarged to show detail) of the embodiment of a belt taken through section N-N in FIG. 32.

DETAILED DESCRIPTION OF THE PREFERRED EMBODIMENT

Figure 1:
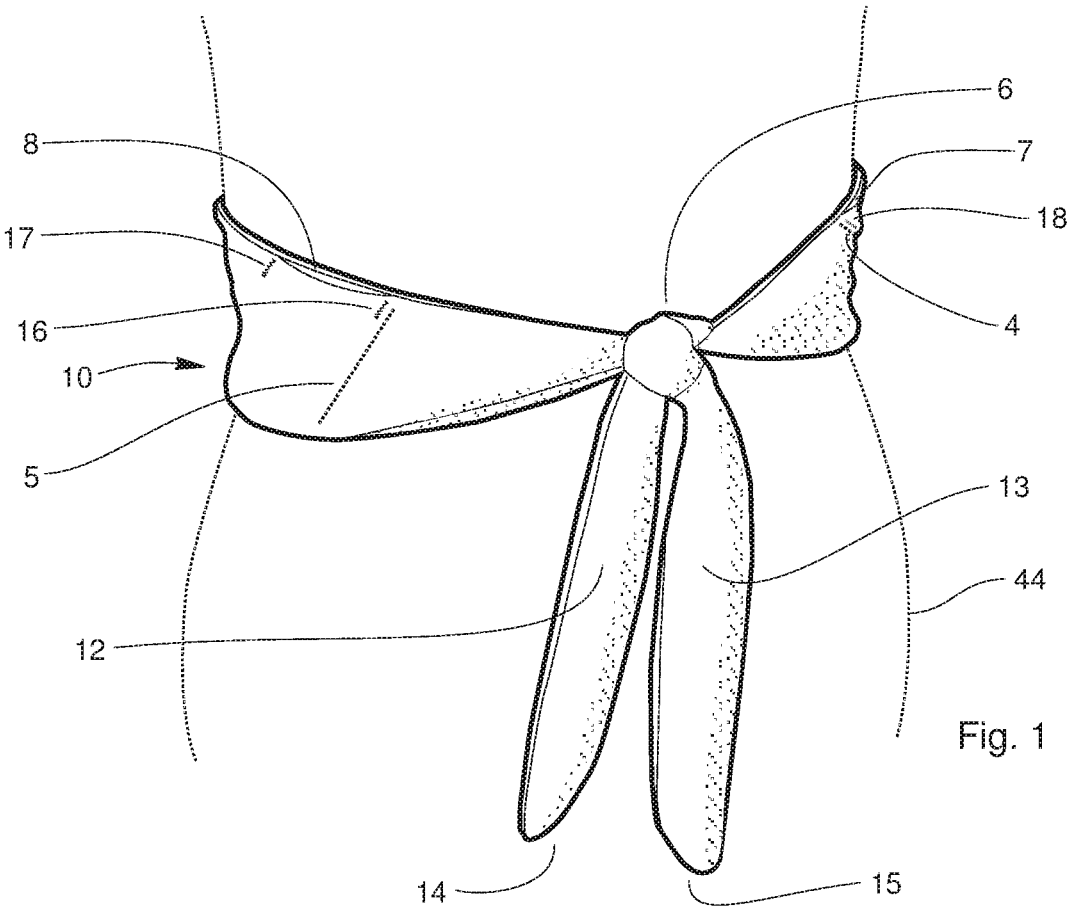
FIG. 1 is a from perspective view of a user wearing a preferred stretch belt with pockets in accordance with the disclosed invention. The belt is shown tied around the waist of a user in such a manner that allows the user to carry items in the pockets.

The following description is only exemplary of the principles of the invention, and should not be viewed as narrowing the scope of the invention.

The preferred stretch belt is made from two stretchy but breathable die-cut or otherwise cut or formed panels, 38 and 39 (see FIGS. 7, 8, 11, 12 and others). Panels 38 and 39 are preferably made from stretch nylon with spandex and/or polyester with spandex or the like wherein the material has a preferred thickness between 0.25 mm and 0.75 mm. In other cases the thickness for the sheet material used is between 0.35 mm and 0.65 mm thick with 0.5 mm being an optimal thickness for panels 38 and 39. The preferred weight of the fabric is between 250 grams per yard and 500 grams per yard (when 58" wide stock material is used). Directional stretch material in some cases may be desirable. For instance if two-way stretch material is used it may be desirable to orient the stretch of the material perpendicular to the length of the belt such that bounce can be controlled, although in some cases it may be desirable to orient the stretch of the material parallel to the length of the belt which could in some cases provide a more fitted stretch reel. Four-way stretch material can also be used and is generally preferable as it gives a desirable comfort feel as well as stretches to fit the contents being carried in the preferable pockets. It is preferable to use an invisible style zipper as a closure for pocket area 1 to close pocket opening 25. If closure means is desired for other pockets then invisible style zippers are also desirable.

FIG. 1 is a front perspective view of a user wearing a belt 10 with pockets in accordance with a preferred version of the invention. The belt is shown tied (with knot 6) around the waist of a user in which a first end of the belt is tied to a second end of the belt. When attached and worn as illustrated, it allows a user to carry items in the pocket areas, e.g. 1, 9, 11. Pocket openings 25, 7 and 8 are used to access the pockets. The belt can be used in many ways and lied in many ways, for example knot 6 could be tied with a bow or other knot style.

Figure 2:
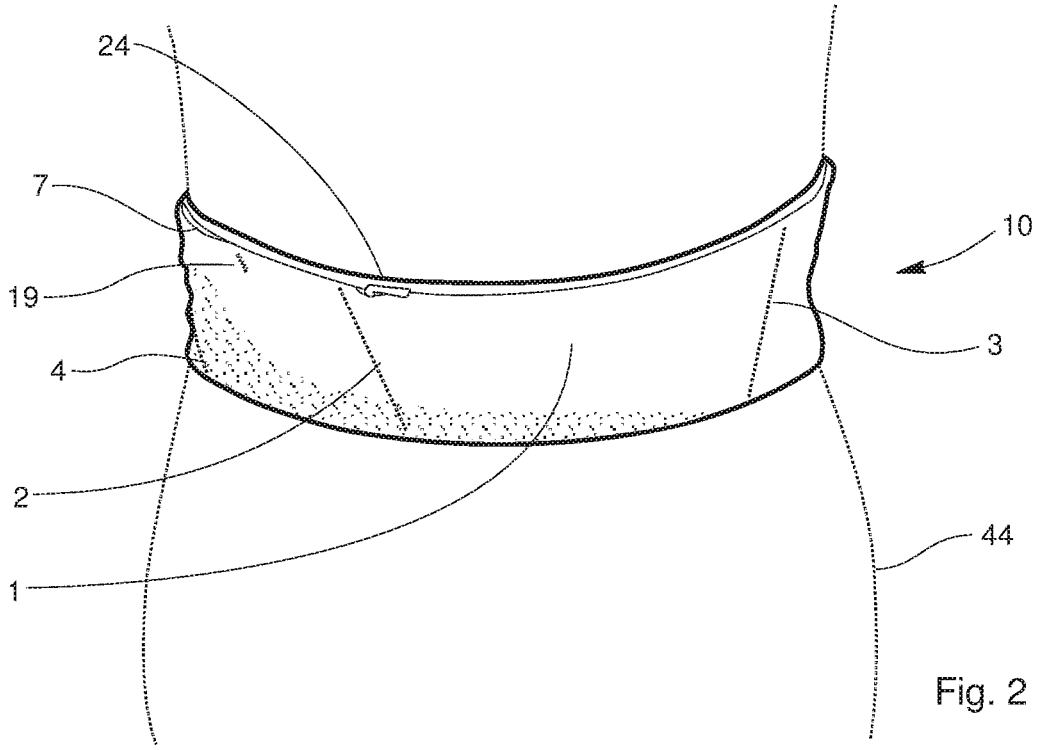
FIG. 2 is a back perspective view of a user wearing a preferred belt.
Figure 7:
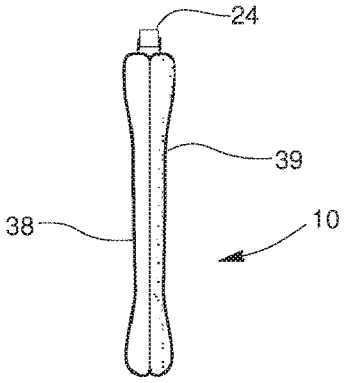
FIG. 7 is a right side view of a preferred belt. The left side preferably is a mirror image thereof as can be seen in FIG. 8.
Figure 8:
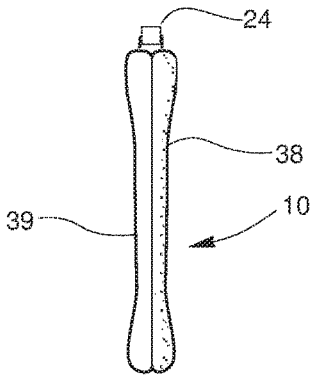
FIG. 8 is a left side view of a preferred belt. The right side view preferably is a mirror image thereof (FIG. 7).
Figure 10:
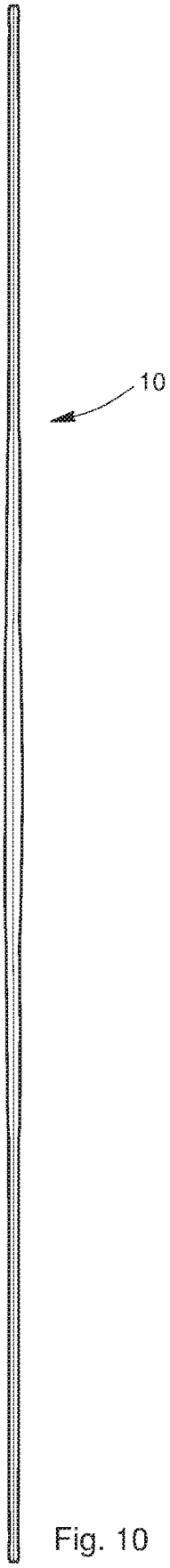
FIG. 10 is a bottom view of a preferred belt.
Figure 9:
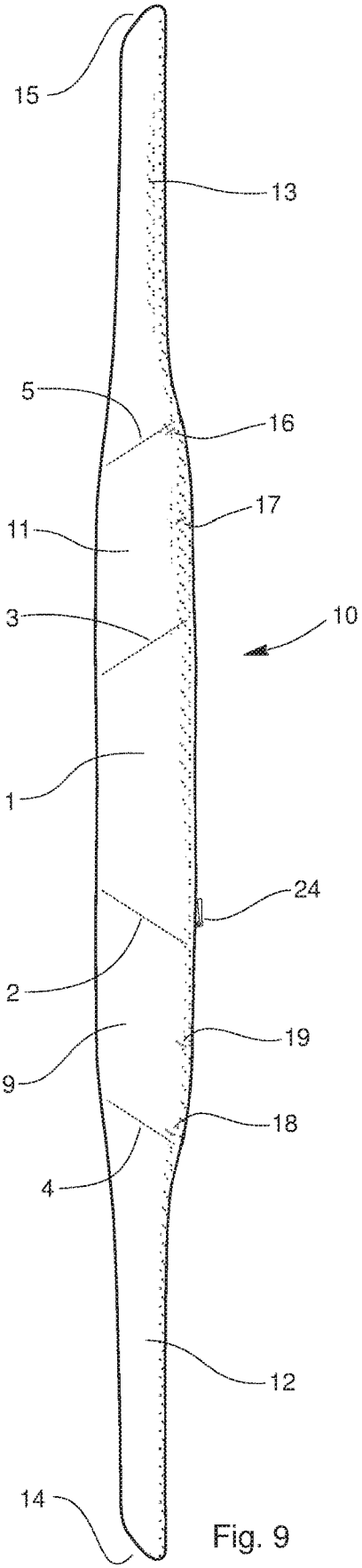
FIG. 9 is a back view of a preferred belt. The from view is preferably a mirror image thereof (FIG. 5).

FIG. 2 is a back perspective view of a user wearing a belt 10 wherein pocket area 1 is divided from other pocket areas by stitch lines 2 and 3 which are preferably stitched through from panel 38 and rear panel 30 (see, e.g., FIG. 7). A closure such as a zipper is configured to enclose the pocket area, and zipper pull 24 can be pulled to open the central pocket area 1 such that opening 25 (which can be seen in FIG. 4) provides access to the pocket area 1.

Figure 3:
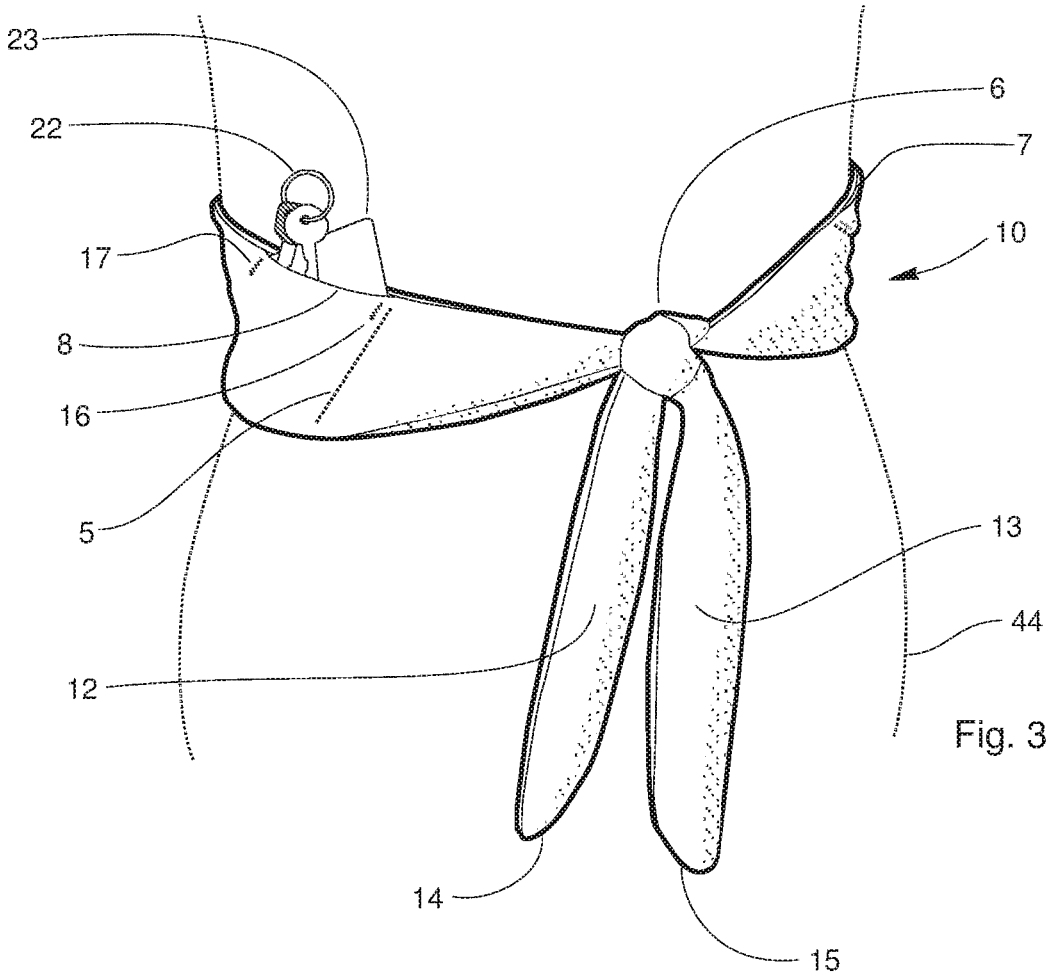
FIG. 3 is a front perspective view of a user wearing a preferred belt wherein keys 22 and card 23 are shown being inserted into pocket opening 8.

FIG. 3 is a front perspective view of a user wearing a belt with pockets as in FIG. 1, in this case showing keys 22 and a card 23 being inserted into pocket opening 8 which is preferably defined along the length of stretch belt 10 by stitch lines 3 and 5. Additional bar-tacks 16 and 17 may be used to further strengthen and define the opening 8.

Figure 4:
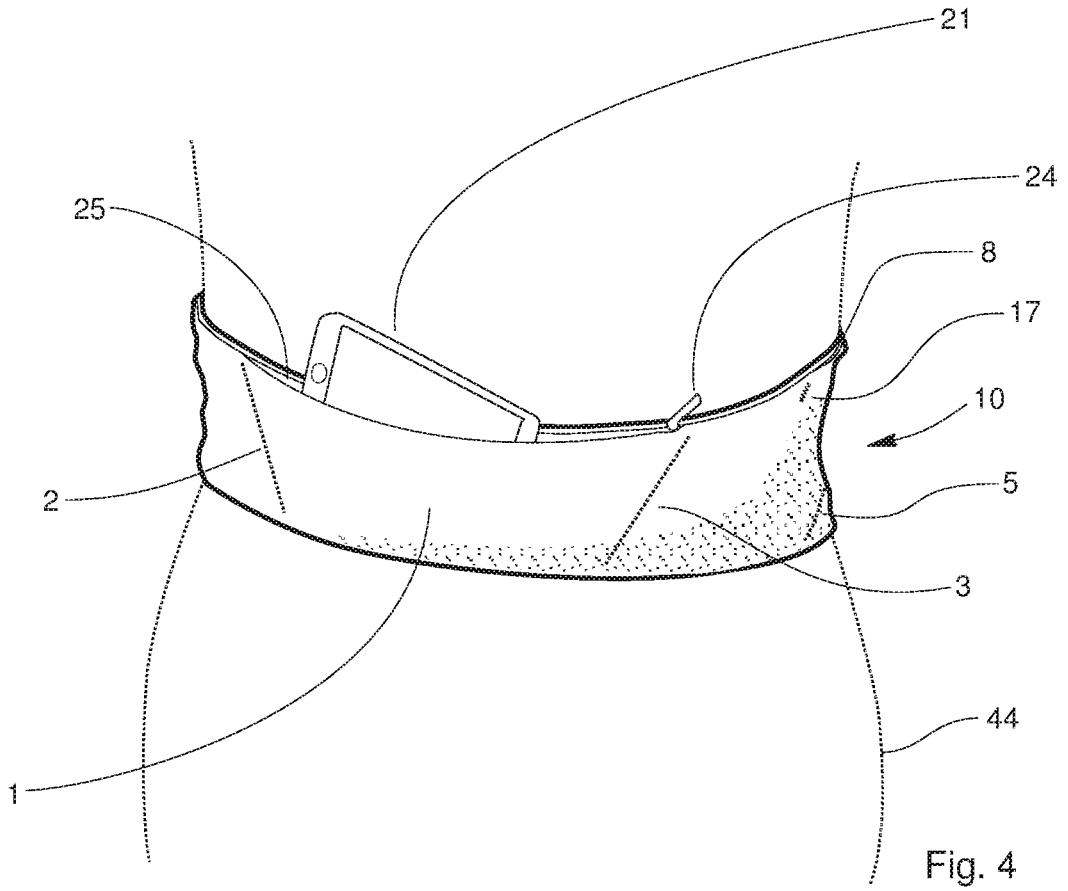
FIG. 4 is a back perspective view of a user wearing a preferred belt wherein cell phone 21 is shown being inserted into a zipper pocket opening 25.
Figure 6:
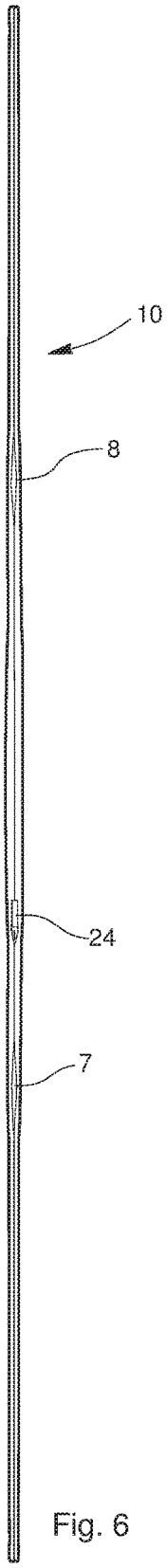
FIG. 6 is a top view of a preferred belt.

FIG. 4 shows zipper pocket area 1 as a centrally placed pocket, with zipper pull 24 in the open position wherein a cell phone 21 is shown being inserted into the pocket opening 25.

Figure 5:
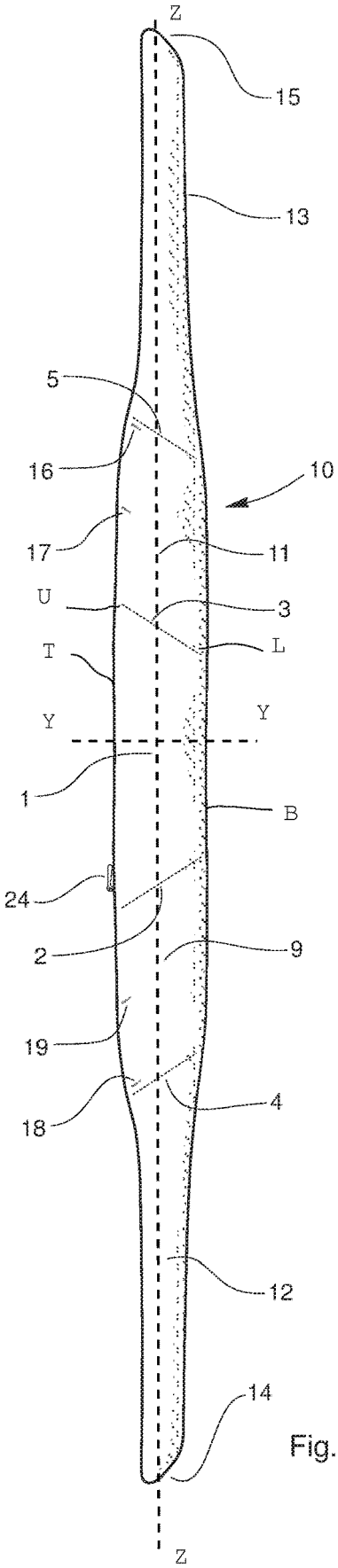
FIG. 5 is a front view of a preferred belt. The back view preferably is a mirror image thereof as shown in FIG. 9.

FIG. 5 shows a preferred belt in which three pockets are defined along the length of belt 10 by stitch lines 2, 4, 3, and 5. In the version as illustrated in FIG. 5, a central axis Z-Z extends along the length of the belt, from a first end 14 to a second end 15 of the belt. A median axis Y-Y bifurcates the belt, corresponding to centerline 40 in FIGS. 11 and 12. As described above, the belt is defined by opposing panels of the belt which are integrally formed and/or separately cut or shaped and joined together. The pockets are defined in the preferred version by intermediate stitch lines which join the opposing panels at intermediate locations between the first and second ends, and in this fashion the stitching provides as a barrier to form lateral internal pocket side boundaries. Bottom boundaries are formed by lower border stitching, and top boundaries are primarily formed by closures such as zippers. In a preferred version as illustrated in FIG. 5, the pocket side boundary stitching is transverse to the central axis Z-Z. More preferably, the pocket side boundary stitching is non-perpendicular to the central axis, and further includes a lower edge e.g. L (that is, the edge more closely adjacent the bottom B of the belt) and an upper edge e.g. U (that is, the edge more closely adjacent the top T of the belt). In a preferred version, the upper edge U of each of the stitch lines 2, 3, 4, 5 is farther away from the median axis Y-Y than is the lower edge U of each of these same stitch lines. At least with respect to the central pocket area 1, this forms a tapered pocket having a wider top and a narrower bottom.

Figure 11:
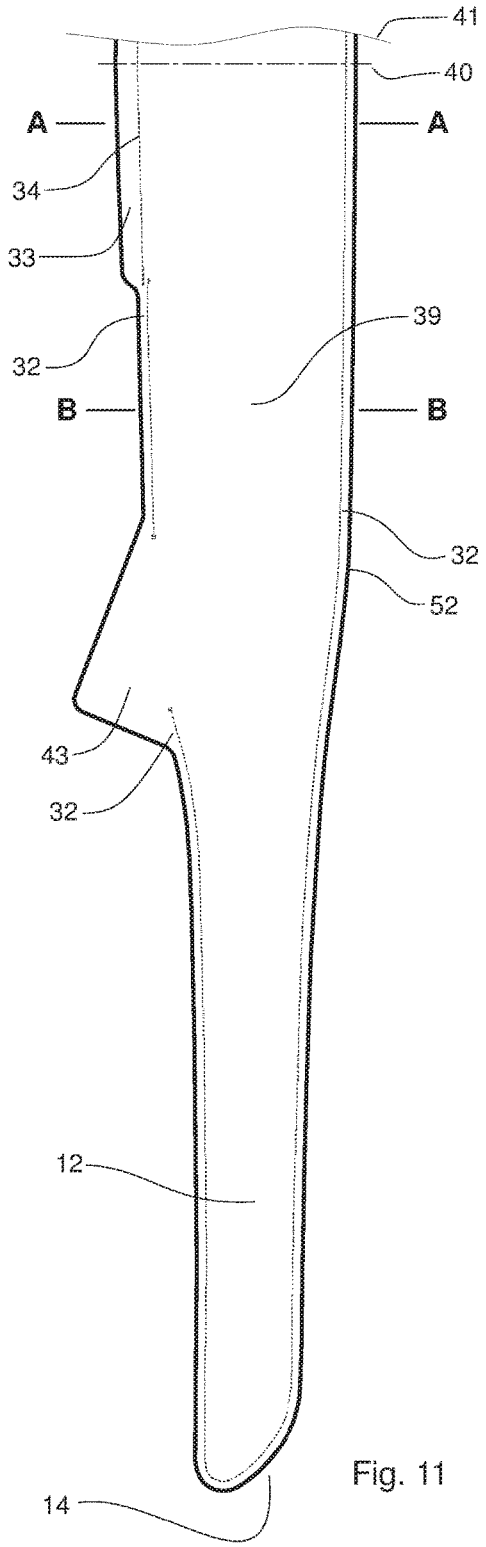
FIG. 11 is a front left-side approximately half cut-away (by cut-away curve 41, and illustrating a center mirror plane line 40) view of a first cut fabric panel in which two such panels are positioned inside out and placed face to face at an intermediate stage of assembly. The other portion (that is, the right-side half, not shown because of the partial cutaway nature of the view) would preferably be a mirror around centerline 40. Although this is described as a front view, because it is shown inside out and is intended to be flipped right side out after it is sewn at its periphery, the rear panel labeled 39 is shown placed on top of front panel 38 (seen in FIG. 12).
Figure 12:
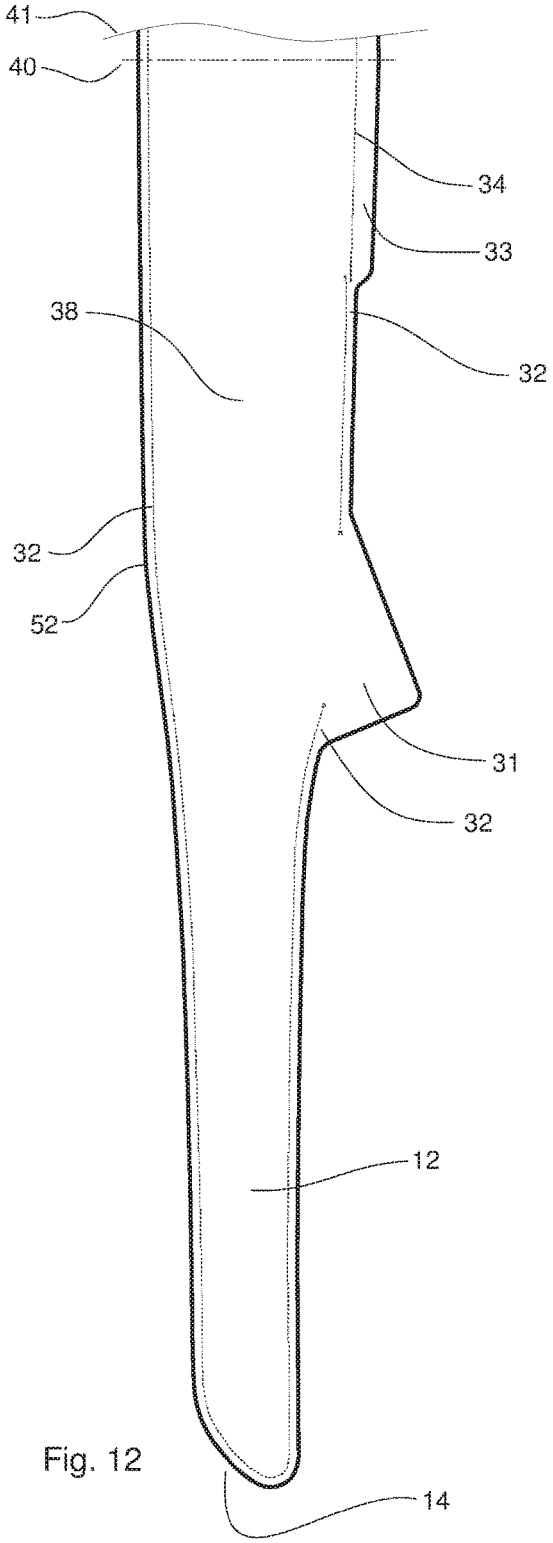
FIG. 12 is a rear view of the cutaway portion of the belt illustrated in FIG. 11, and in this illustration the front panel 38 is visible whereas the rear panel 38 is not.

FIG. 11 is a front partial cut-away view of a left side of a fabric panel 39 shown inside out, and which is placed face to face against a corresponding mating panel 39 shown in mirror-view in FIG. 12. The other portion (that is, the right-side) would preferably be a mirror image around centerline 40 (which as noted above corresponds to media axis Y-Y seen in FIG. 5). Although FIG. 11 is described as a front view, because it is shown inside our and is intended to be flipped right side out after it is attached (such as by sewing) at its periphery, the rear panel 39 is shown placed on top of front panel 38. In FIGS. 11 and 12, the pocket flaps 31, 43 are illustrated and defined as part of the cut panels.

Figure 13:
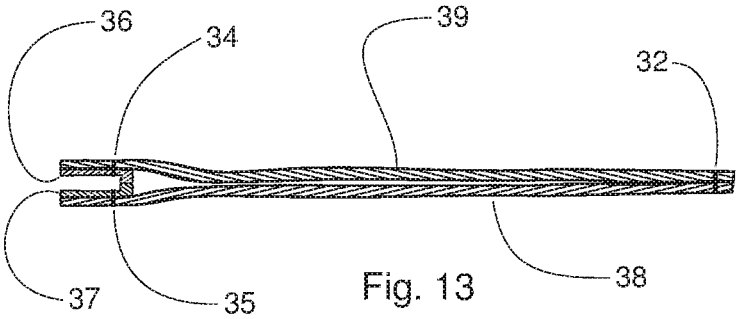
FIG. 13 is a section view taken through section A-A of FIG. 11.
Figure 14:
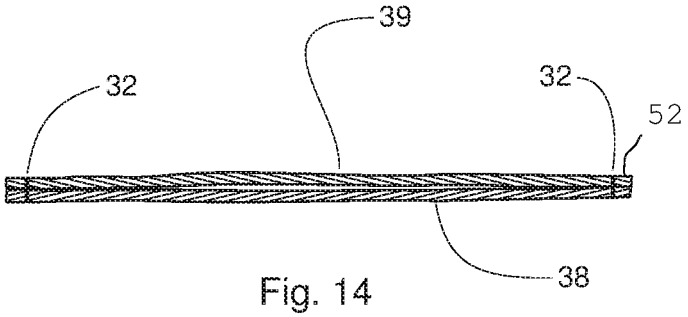
FIG. 14 is a section view taken through section B-B of FIG. 11.

FIG. 13 is a sectional view showing how zipper half 36 is preferably sewn to the rear panel 39 along a stitch line 34 and zipper half 37 is sewn to the front panel 38 along a stitch line 35. In the manufacturing process, the front and rear panels 38 and 39 are preferably placed face to face (and inside out) as shown in FIG. 13 and FIG. 14, then sewn along their periphery, preferably sewing along stitch 32 shown in FIGS. 11-14 and others. Appropriate seam allowances are shown between the outer boundary of the panels and the actual stitch line. The permanently closed periphery 42 (shown as a thick black line in FIG. 16) of the belt is defined after the panels are stitched together and then turned right-side out.

Figure 15:
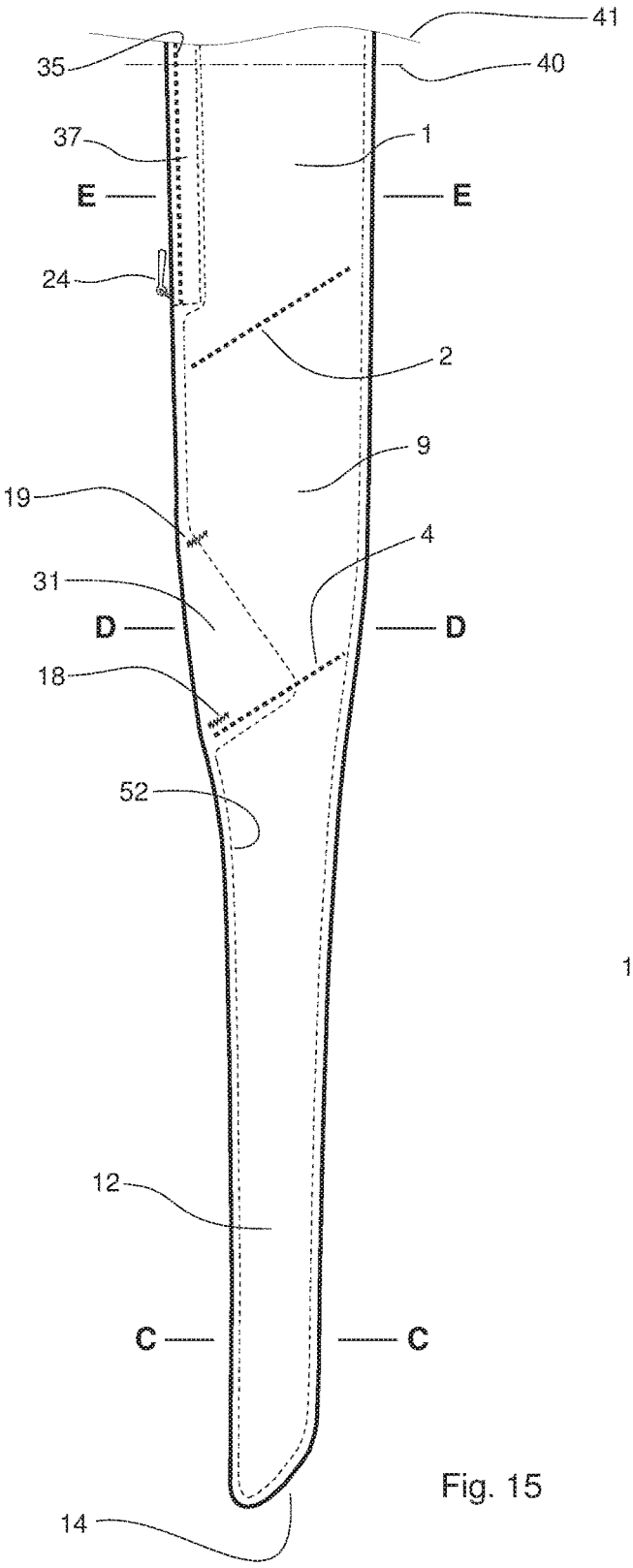
FIG. 15 is a front left-side partial cut-away view corresponding to that of FIG. 11, but in this case showing an assembled portion of a preferred belt with front and rear panel assembled together, sewn in place, and inverted. Perimeter line 52 is shown in hidden line as it represents the edge of the inverted fabric and would not be seen from the outside of the stretch belt. Internal zipper portion 37 is also shown in hidden line as it would not be seen from the outside of the stretch belt. Broken lines 2 and 4 represent stitching through the panes dividing the stretch belt into pocket sections and preferably would be visible from the outside of the belt. Further stitch line 35 is shown in this view (although preferably would not be visible from the outside of the stretch belt) and it attaches a hidden zipper portion 37 to from panel 38. The other half of the belt (right-side) would preferably be a mirror around centerline 40.
Figure 16:
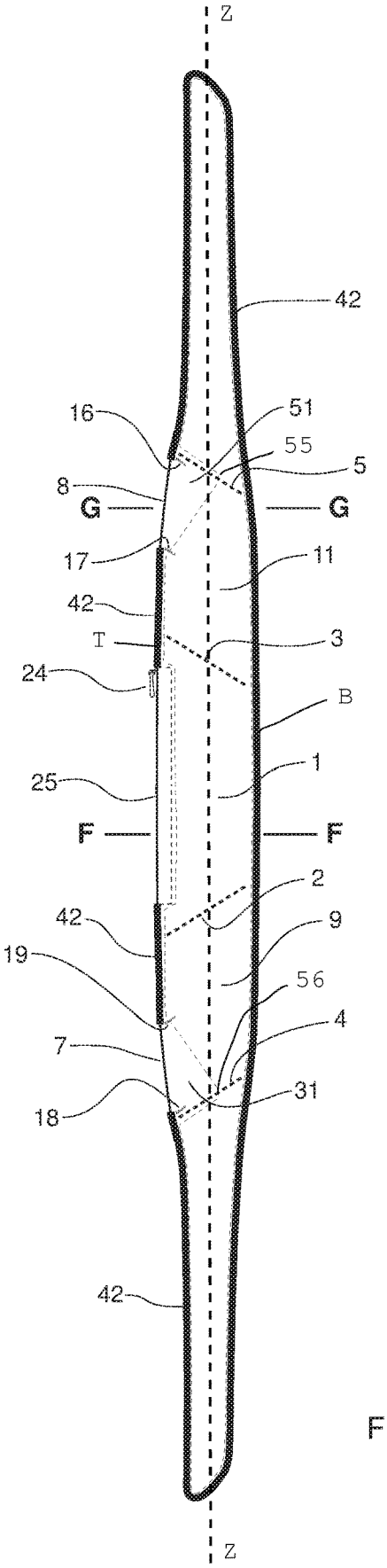
FIG. 16 is a front left-side partial cut-away view of an assembled portion of a belt. Some features that preferably would not be visible from the outside of the stretch belt are shown in hidden line. Thick line 42 is shown which represents perimeter stitching 32 (see FIGS. 11-14) of front panel 38 to rear panel 39 such that pocket openings 7, 8 and 25 would be formed. Stitch lines 2, 3, 4 and 5 are shown. Zipper pull 24 is shown moved to an open position such that the pocket 1 is accessible through opening 25.
Figure 19:
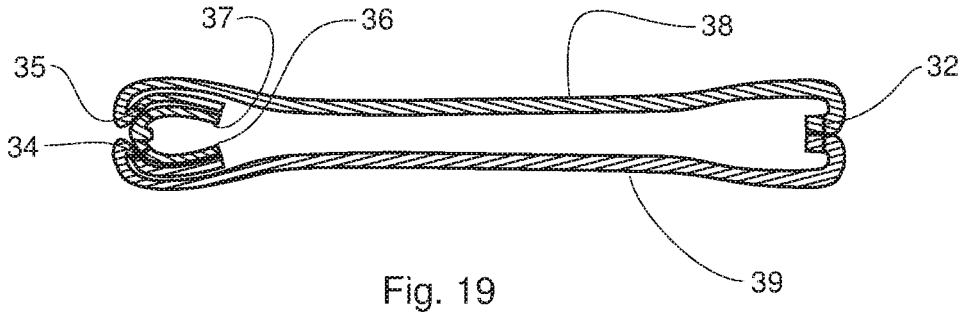
FIG. 19 is a sectional view (enlarged to show detail) of the belt taken through section E-E in FIG. 15.

The zipper halves 36 and 37 are installed to the panels 39 and 38 respectively by sewing along stitch lines 34 and 35 respectively. In addition, the stitch line 32 fastens the two panels 38 and 39 at their periphery, but stopping to allow for pocket openings 7, 8 and 25 as shown in FIG. 16 and others. Zipper pull 24 can be preinstalled on zipper halves 36 and 37 (and left unzipped) or installed after 36 and 37 are sewn to panels 39 and 38. Then, the stretch belt is inverted preferably through the central pocket opening 25 (with the zipper unzipped, and the pull 24 in an open position). With panels 38 and 39 inverted (as can be seen and more easily understood in cross sections in FIGS. 17-21) such that panels 38 and 39 are now right side out, the seam allowance periphery 52 (see, e.g. FIG. 14) is now inside as can be seen in FIG. 15 and others. In addition, the pocket interior flaps (31 and opposing flap 43; and 51 and its opposing flap 53) extend down inside between the front and rear panels 38 and 39 as can be more easily understood in FIGS. 15, 16, 18 and 21.

Figure 21:
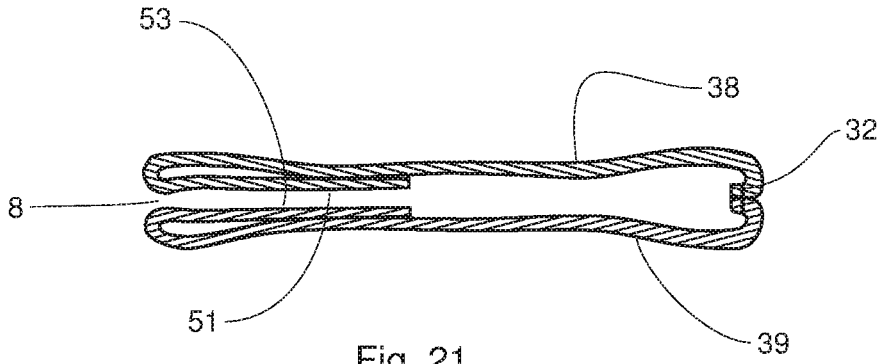
FIG. 21 is a sectional view (enlarged to show detail) of the belt taken through section G-G in FIG. 16.
Figure 20:
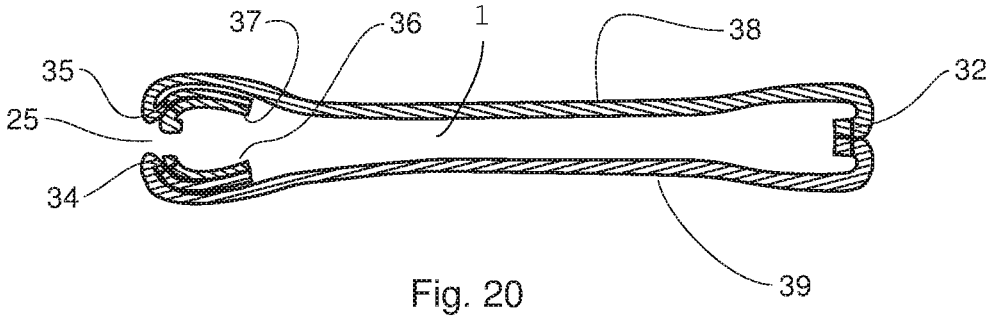
FIG. 20 is a sectional view (enlarged to show detail) of the belt taken through section F-F in FIG. 16 wherein zipper is unzipped to open zipper pocket such that pocket opening 25 allows objects to be placed in the zipper pocket area 1.

Panels 38 and 39 are then stitched together along pocket side boundary stitch lines 2, 3, 4 and 5 through panels 38 and 39. A first outermost stitch line 4 is stitched through the front and rear panels 38, 39, including through edges of the pocket flaps 31, 43, as can be more easily understood in FIG. 15 and FIG. 18, such that pocket interior flap 31 and opposing flap 43 are sewn napped in between panels 38 and 30. Similarly, an opposing second outermost stitch line 5 is stitched through the front and rear panels 38, 39 as well as the corresponding flap portions 51, 53, as can be seen in FIG. 16 and FIG. 21 such that pocket interior flap 51 and opposing flap 53 are sewn trapped in between panels 38 and 39.

Bar-tacks 16, and 17 are preferably then sewn through panels flaps 38, 51, 53 and 39 to further strengthen and define a second side pocket opening 8 and further secure flaps 51 and 53 between panels 38 and 39. Also bar-tacks 18, and 19 are preferably then sewn through panels/flaps 38, 31, 43 and 39 to further strengthen and define a first side pocket opening 7 and further secure flaps 31 and 43 between panels 38 and 39.

The assembled stretch belt is preferably pressed flat with a hot iron, heat press, hot iron press, steam press or the like such that a permanent crease is formed at its periphery and thus holds its shape in this pressed flat form. Although not necessary, a bar tack can also be placed on either side of the central zipper pocket opening 25 (through panels 38 and 39) to define and further strengthen the preferable zipper pocket opening.

As can be further understood in FIGS. 15, 16, 19, 21 and others pocket interior flaps 31 and 43 extend downward from the top of the first pocket opening 7 and pocket interior flaps 51 and 53 extend downward from the top of the second pocket opening 8, and they are fastened there by stitch lines 4, 5 and bar-tacks 16-19. In this way, the pocket flaps substantially line the interior and the openings of the pockets to provide structure and a quality finished look to these openings and extra security and reinforcement for the pockets. Openings 7 and 8 are preferably further defined and flattened in a desirable pocket opening shape when the belt is heat-pressed or otherwise pressed flat.

Tie ends 14 and 15 can be shaped in many ways as desirable, for example the ends 14 and 15 could be finished with a half circular end, a more arrow-shaped style, a squared-off end like a bathrobe belt or many other shapes as desired to finish the ends of the belt in an aesthetically desirable way. The shape as shown in the preferred embodiment is desirable although for some applications or situations a different shape such as a bullet-shaped end may be desired.

FIG. 16 shows thick line 42 extending about the perimeter of the belt which represents the approximate location of perimeter stitching 32 which fastens the front panel 38 to the rear panel 39. It can be seen in FIG. 16 that thick line 42 (and therefore the perimeter stitching) stops where pocket openings 7, 8, and 25 begin, thereby aiding in defining the pocket openings.

The pocket flaps 31, 51 are shown in broken lines in FIG. 16, indicating that they are sandwiched between the front and rear panels 38, 39 of the belt and not visible when the flaps are joined together and folded into the belt in the configuration of FIG. 16. Each of the pocket flaps includes a deepest portion of the pocket 55, 56 formed by the flaps, and in the version as illustrated in FIG. 16 the pocket flaps, including the deepest portion of the pocket 55, 56 extends from the top end of the belt T toward the bottom end of the belt B, at least to a distance equal to or beyond the central axis Z-Z. In each case with the flaps being joined together and inverted, they serve to line the inside of the respective pockets.

Zipper halves 36 and 37 are closeable such that the central pocket opening 25 is closeable with zipper slider 24. Preferably the type of zipper that is used is a hidden (concealed or invisible) style zipper such that it is substantially not visible except for zipper slider 24.

Figure 18:
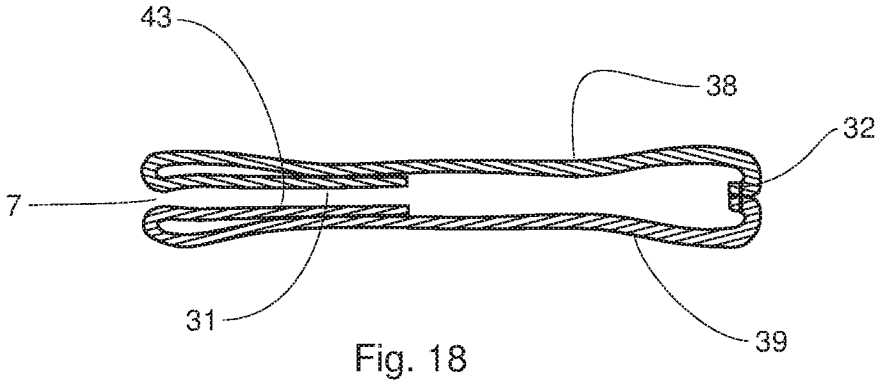
FIG. 18 is a sectional view (enlarged to show detail) of the belt taken through section D-D in FIG. 15.
Figure 17:
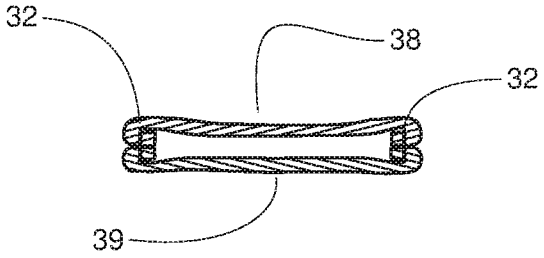
FIG. 17 is a sectional view (enlarged to show detail) of the belt taken through section C-C in FIG. 15. In the sectional views shown, in order for the clarity of the views the thickness of the material in sections is exaggerated such that section lines can be seen and structure of construction can be more easily understood.

FIG. 17 is a section view showing how, after the belt is heat pressed, the edges are pressed substantially flat substantially giving the stretch belt a desirable finished look. FIG. 18 illustrates the belt in sectional view before heat pressing and showing it as puckered and less flat. In some cases it may be desirable to heat press only portions of the belt, such as the tie ends 14 and 15, the tie portion from the ends 14 and 15 to the pocket area, or the whole belt except for the zipper area.

FIGS. 22 through 35 represent a number of alternate embodiments and construction techniques that in some cases may be desirable.

Figure 22:
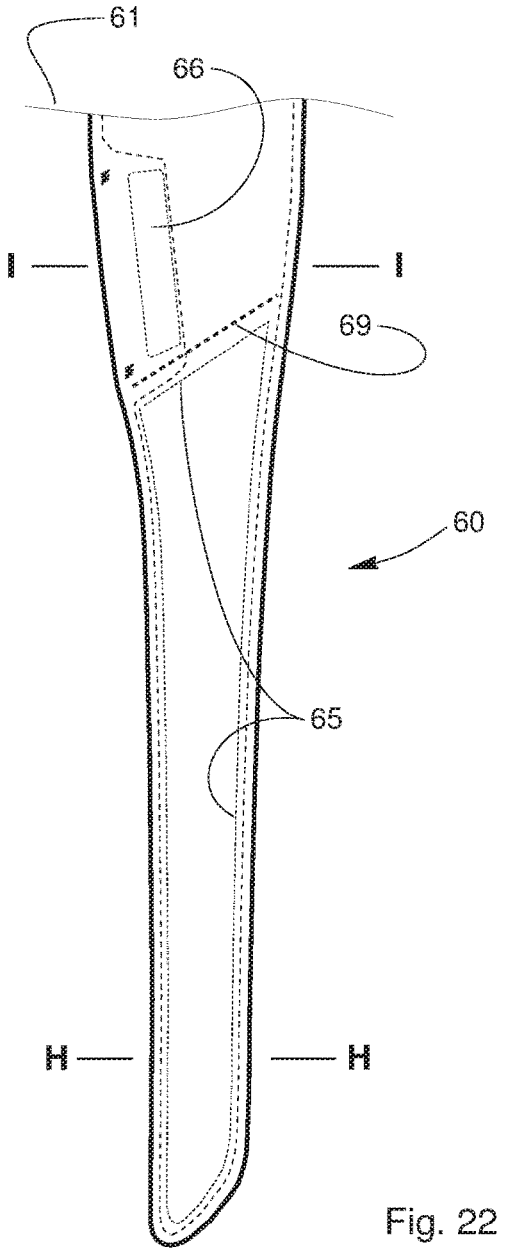
FIG. 22 is a front, partial cut-away view of an assembled portion of an alternate embodiment of a stretch belt. Some features that preferably would not be visible from the outside of the belt are shown in hidden lines. Stitch line 69 is shown.

FIG. 22 is a front view of assembled portion of a second construction configuration. Some features that would not be preferably visible from the outside of the stretch belt are shown in hidden lines. Stitch line 69 is shown as extending through front panel 62 and rear panel 63 (see FIGS. 23-26) trapping flaps 67 and 68. Flaps 67 and 68 in this embodiment are shown as being more rectangular in shape than the more triangular shape of the prior version. In this example, a heat set adhesive (or the like) is preferably placed between flap 68 and panel 62 and flap 67 and panel 63, affixing these panels together.

Figure 24:
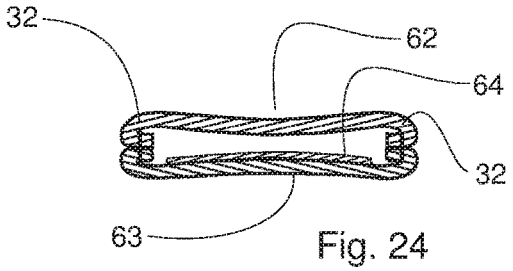
FIGS. 23-25 represent cross-sections showing different construction embodiments wherein different methods of construction are disclosed.
Figure 23:
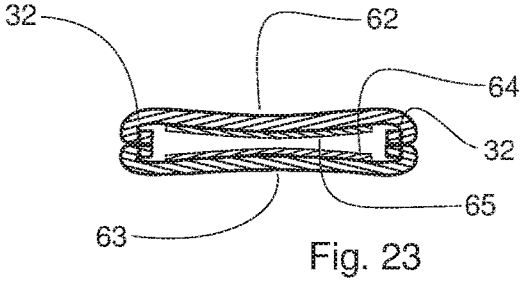
Figure 25:
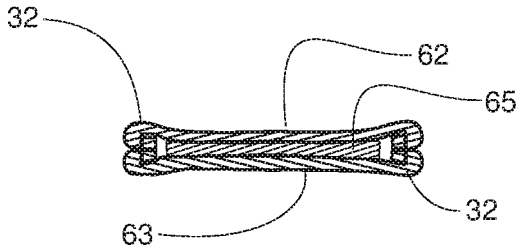

FIGS. 23-25 represent optional construction methods of constructing a portion of the tie ends of the stretch belt. FIG. 23 shows a cross section wherein an area of the surface of the inside of the belt is stiffened slightly with a resilient layer 64 and 65 which is comprised of silk screened on ink, stiffener, heat transfer, appliqué or other methods. When a portion of the tie ends of the belt are coated or reinforced in this manner, it adds some slight stiffness and resilience such that the tie end portion of the belt from the vicinity of the pocket areas to the ends of the belt is produced with greater stiffness. In FIG. 22 the stitch line 65 provided peripherally outward from the boundary stitch line 69 represents an approximate boundary for the internal resilient layer as represented by hidden line 65.

FIG. 24 is a section view (enlarged to show detail) of another embodiment of a stretch belt taken through section G-G in FIG. 22. In this example, the panel 63 has a resilient layer associated with it, but the opposing panel 62 does not. For the purposes of this embodiment either the front 62 or the back panel 63 could incorporate an additional resilient or stiffening layer.

FIG. 25 is a section view of a portion (enlarged to show detail) of another embodiment of a stretch belt tie end portion taken through section H-H in FIG. 22. In this version, an internal layer such as resilient member 65 is inserted, applied or otherwise placed in between panels 62 and 63. The insertion of the internal layer is configured such that the tie portion of the belt can be made more resilient by adding the internal layer 65, which could be made from webbing (stretch or nylon or the like), neoprene or the like, lycra, rubber, or other material that would add some resilience and structure. The internal member 65 can be inserted between panels 62 and 63 and affixed and/or trapped by adhesive, stitching or just trapped between panels 62 and 63.

Figure 26:
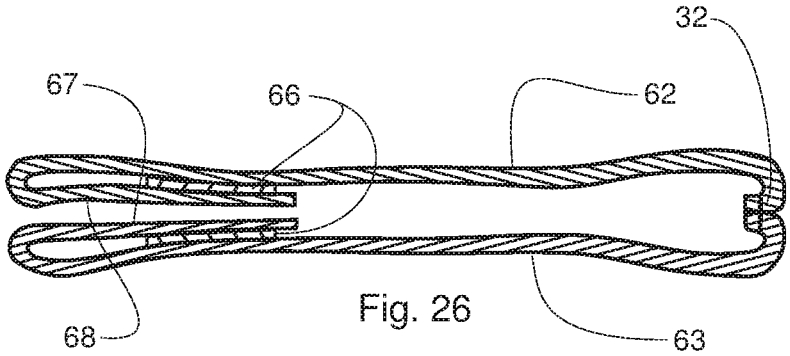
FIG. 26 is a sectional view of a portion (enlarged to show detail) of an embodiment of a stretch belt taken through section I-I in FIG. 22.

FIG. 26 is a section view of a portion (enlarged to show detail) of a pocket area construction method for a stretch belt, taken through section I-I in FIG. 22. Flaps 67 and 68 in this embodiment are shown in which a heat set adhesive is placed in between flap 68 and panel 62 and flap 67 and panel 63, affixing these panels together.

Figure 27:
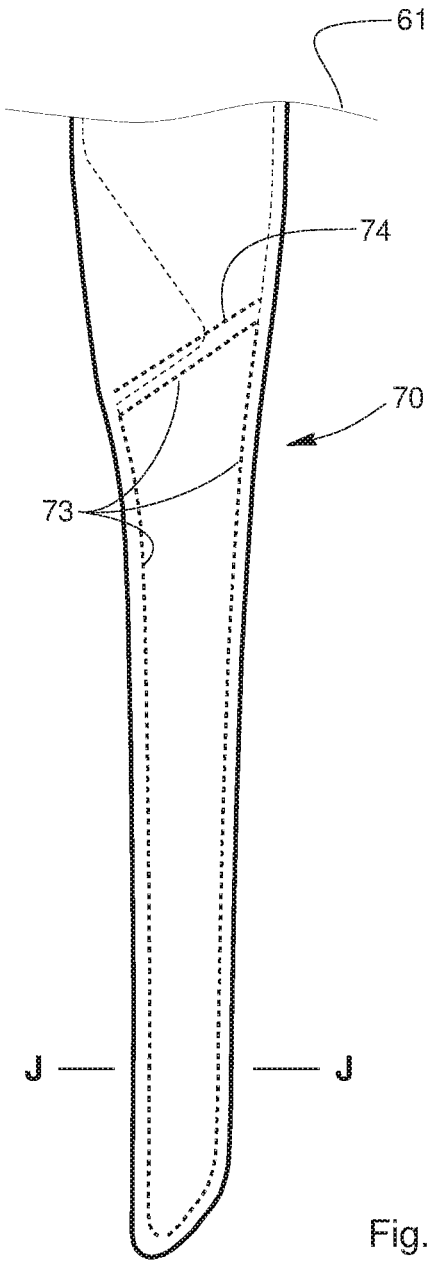
FIG. 27 is a front view of an assembled portion of another embodiment of the belt. Some features that preferably would not be visible from the outside of the belt are shown in hidden lines. Stitch line 74 is shown and stitch lines 73 are shown wherein stitch line 74 and stitch lines 73 would be generally visible.
Figure 28:
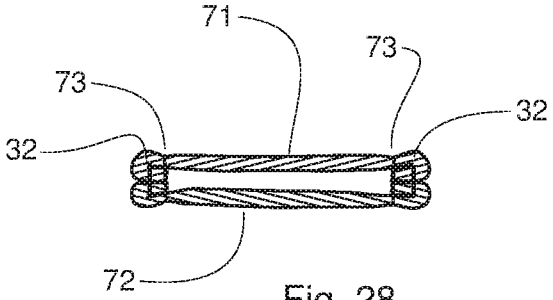
FIG. 28 is a sectional view of a portion (enlarged to show detail) of an embodiment of the belt taken through section J-J in FIG. 27.

FIG. 27 is a front view of an assembled portion of another construction method for a stretch belt. Some features that preferably would not be visible from the outside of the belt are shown in hidden lines, for example the seam allowance that would preferably be inverted inside the belt is shown in hidden line. Stitch line 74 would be a stitch as disclosed above to provide a pocket separation as well as fasten pocket inter or flaps in place. Additional stitch lines 73 are shown, representing a stitched-down area wherein after the belt is inverted the tie portion of the belt is stitched around its perimeter to itself as can be seen in cross section in FIG. 28 such that stitching 73 holds the tie portion of the belt together in this flattened state. The stitching 73 could be stretch style or conventional straight stitch as well as zig-zag or over-lock or the like. FIG. 28 shows how stitching 73 can be stitched at the periphery (or thereabouts) of the portion of the belt to fasten panels 71 and 72 in a flattened form.

Figure 29:
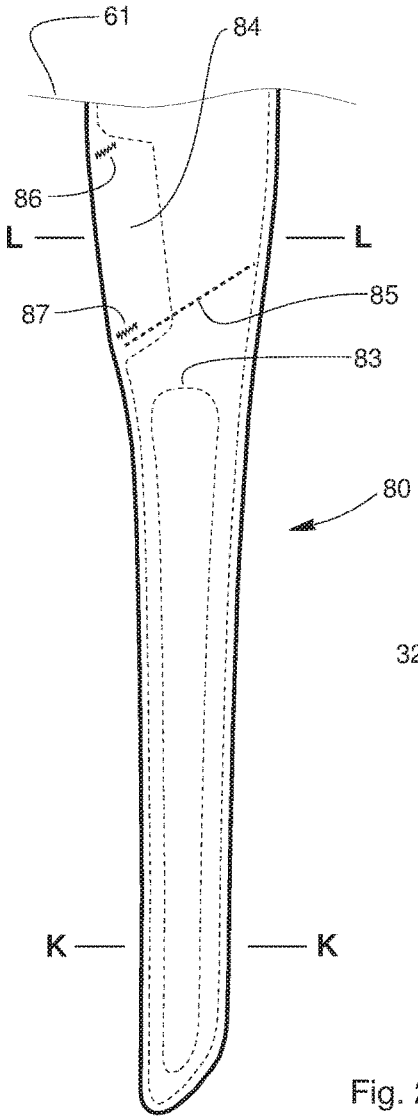
FIG. 29 is a front view of an assembled portion of an embodiment of a belt. Some features that preferably would not be visible from the outside of the stretch belt are shown in hidden lines. Stitch line 85 is shown and would be generally visible.
Figure 31:
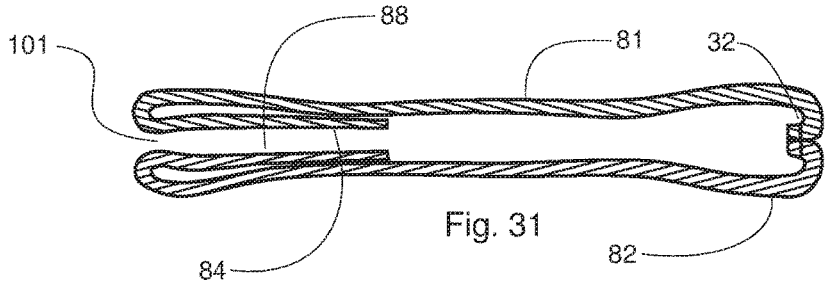
FIG. 31 is a sectional view of a portion (enlarged to show detail) of the embodiment of a belt taken through section L-L in FIG. 29.
Figure 30:
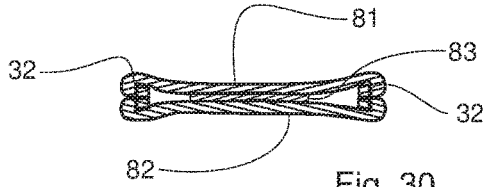
FIG. 30 is a sectional view of a portion (enlarged to show detail) of the embodiment of a belt taken through section K-K in FIG. 29.
Figure 35:
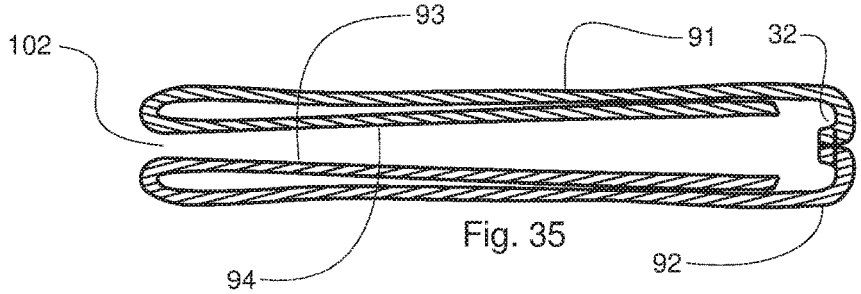
FIG. 34-35 represent cross-sections showing different construction embodiments wherein different methods of construction are disclosed.

FIG. 29 is a front view of assembled portion of another construction method for a stretch belt. Some features that preferably would not be visible from the outside of the stretch belt are shown in hidden lines, for example the seam allowance. Pocket interior flaps 84 and 88 (see also FIG. 31) are shown such that they are more rectangular-shaped such as shown in the embodiment of FIG. 22. Stitch line 85 is shown, bar tacks 86 and 87 are also shown to help strengthen and define pocket opening 101 as seen in FIG. 31. A hidden resilient feature 83 is shown in hidden lines wherein an internal resilience member 83 is inserted, applied or otherwise fixed in between panels 81 and 82 such that the tie portion of the belt can be made more resilient such as described above, as well as fasten front panel 81 to rear panel 82 as can be seen in section view FIG. 30. Resilience member 83 could be die-cut and affixed by adhesive, screened in place using ink-type application or otherwise trapped between panels 81 and 82.

Figure 32:
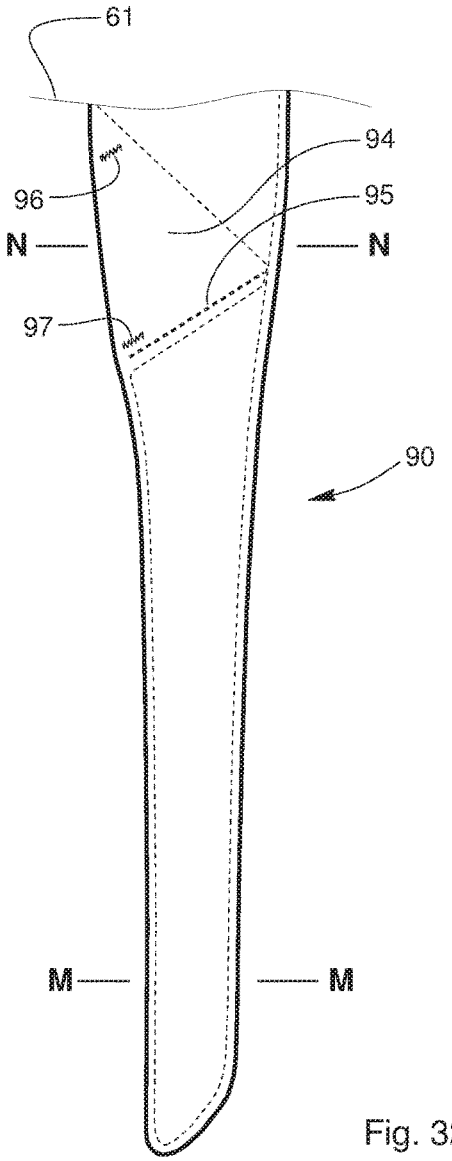
FIG. 32 is a front view of assembled portion of a an embodiment of a stretch belt. Some features that preferably would not be visible from the outside of the stretch belt are shown in hidden lines. Stitch line 95 is shown and would be generally visible.

FIG. 32 is a front view of an assembled portion of another construction method for a stretch belt. Some features that preferably would not be visible from the outside of the belt are shown in hidden lines. Pocket interior flaps 93 and 94 are shown (see FIG. 35) such that they are a triangular-shaped similar to the embodiment shown in FIG. 15. In this embodiment pocket interior flaps 93 and 94 extend down substantially to the bottom of the belt. This size of flap is deeper and uses more fabric than the embodiment shown in FIG. 15.

Figure 34:
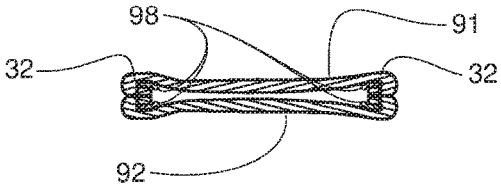
Figure 33:
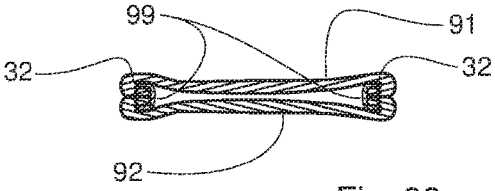
FIG. 33 is a sectional view of a portion (enlarged to show detail) of the embodiment of a belt taken through section M-M in FIG. 32.

FIG. 33 shows a construction method of the tie portion of the belt wherein the seam allowance is edge-bound or otherwise covered with a material that is impregnated with heat applied adhesive 99 such that when the belt is heat pressed in the final stage of production the edges of the belt are affixed and held together. FIG. 34 shows a construction method wherein sections of the belt are applied (such as silk screened or the like) with heat sensitive adhesive 98 such that the edges of the lie portion of the belt are affixed and held together whereby a flatted shape is achieved.

A stretch belt with pockets 10 is preferably constructed by sewing substantially flat die-cut panels of fabric or other material together generally at their periphery. The belt can also be constructed by knitting, gluing, integrally forming and/or otherwise fastening pans together that have been manufactured from a variety of processes and techniques. Preferably fabric panels/parts of the belt 10 are die-cut from pliable and somewhat stretchy fabric as described above. Some materials that could be used with different degrees of success are spandex, spandura, stretch denim or others. Panel parts can be constructed in a number fabrics of different materials. The belt could be constructed in a variety of different ways other than the cut and sewn manner described for the preferred version. For example various parts of the invention could be combined, formed as one, woven, heat sealed together, ultrasonically bonded together or formed in other ways.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

We claim:

1. A belt, comprising:

a front panel joined to an opposing rear panel to form the belt having a first end and an opposing second end and a top and an opposing bottom, with an interior space between the front panel and the rear panel, each of the first end and the second end being free of buckles or clasps, the belt being positionable about the waist of a user and the first end and second end being sufficiently flexible such that the first end and second end may be tied together to affix the belt about the waist of the user;

each of the front and rear panels being formed from a breathable fabric;

the belt defining a central axis extending from the first end to the second end, and a median axis perpendicular to the central axis and being positioned at a midpoint between the first end and the second end;

a central pocket being formed between the front panel and the rear panel, the central pocket overlying the median axis and having an opening selectively encloseable by a closure, the central pocket being formed by a first central side pocket stitch line joining the front panel to the rear panel and a second central side pocket stitch line joining the front panel to the rear panel;

the front panel having a first front belt flap integrally formed with the front panel;

the rear panel having a first rear belt flap integrally formed with the rear panel;

the first front belt flap being joined to the first rear belt flap, each of the first front belt flap and the first rear belt flap being folded into the interior space to define a first side pocket which extends toward the central axis;

wherein the front panel further comprises a second front belt flap integrally formed with the front panel, the rear panel comprises a second rear belt flap integrally formed with the rear panel, the second front belt flap being joined to the second rear belt flap, each of the second front belt flap and the second rear belt flap being folded into the interior space to define a second side pocket which extends toward the central axis, and wherein the first side pocket is positioned between the central pocket and the first end, and the second side pocket is positioned between the central pocket and the second end, the second side pocket having an opening at the top of the belt.

2. The belt of claim 1, wherein the closure comprises a zipper.

3. The belt of claim 1, wherein an upper end of the first central side pocket stitch line is farther away from the median axis than a lower end of the first central side pocket stitch line.

4. The belt of claim 1, wherein the size of the central pocket is defined by the top and the opposing bottom of the front and rear panels, and by the first central side pocket stitch line and the second central side pocket stitch line, the central pocket being wider along the top than at the bottom.

5. The belt of claim 1, wherein the first side pocket is defined by a third side pocket stitch line positioned between the first central side pocket stitch line and the first end and joining the first panel to the second panel, and wherein the second side pocket is defined by a fourth side pocket stitch line positioned between the second central side pocket stitch line and the second end and joining the first panel to the second panel, both the first and the second side pockets having an inside and an outside.

6. The belt of claim 5, wherein the third side pocket stitch line has an upper edge at the top of the belt and a lower edge at the bottom of the belt, the upper edge having an upper edge distance to the median axis and the lower edge having a lower edge distance to the median axis, the upper edge distance being greater than the lower edge distance.

7. The belt of claim 6 wherein:

the first front belt flap and the first rear belt flap are sandwiched between the front panel and the rear panel by the third side pocket stitch line, the third side pocket stitch line extending through the first front belt flap and the first rear belt flap; and the second front belt flap and the second rear belt flap are sandwiched between the front and the rear panel by the fourth side pocket stitch line, the fourth side pocket stitch line extending through the second front belt flap and the second rear belt flap.

8. The belt of claim 7 wherein both the first front belt flap, the second front belt flap, the first rear belt flap, and the second rear belt flap extend from the top of the belt toward the bottom at least to the central axis.

9. A belt, comprising:

a front panel joined to an opposing rear panel, each of the front and rear panels being formed from a breathable fabric;

each of the front panel and the rear panel having a first end defining a first end of the belt and an opposing second end defining a second end of the belt, and a top at a top of the belt and an opposing bottom at a bottom of the belt;

the belt defining a central axis extending from the first end to the second end, and a median axis perpendicular to the central axis and being positioned at a midpoint between the first end and the second end;

a central pocket being formed between the front panel and the rear panel, the central pocket being positioned between the first end and the second end and having an opening selectively encloseable by a closure, the central pocket further having a height between the top and the bottom of the belt;

the first end of the belt and the second end of the belt each having a height which is shorter than the height of the central pocket;

each of the first end and the second end being free of buckles or clasps, the first end and the second end further being sufficiently flexible such that the first end and the second end may be tied together to affix the belt about the waist of a user;

the central pocket further being formed by a first central side pocket stitch line joining the front panel to the rear panel and a second central side pocket stitch line joining the front panel to the rear panel;

wherein the first central side pocket stitch line extends from a first upper edge to a first lower edge, the first upper edge being closer to the first end of the belt than the first lower edge is to the first end of the belt, and wherein the second central side pocket stitch line extends from a second upper edge to a second lower edge, the second upper edge being closer to the second end of the belt than the second lower edge is to the second end of the belt, whereby the central pocket is wider along the top of the belt than at the bottom of the belt; and a first side pocket being positioned between the central pocket and the first end, the first side pocket having an inside and an outside with a first side pocket opening at the top of the belt, the first side pocket being defined by a third side pocket stitch line positioned between the first central side pocket stitch line and the first end;

wherein the third side pocket stitch line extends from a third upper edge to a third lower edge, the third upper edge being closer to the first end of the belt than the third lower edge is to the first end of the belt;

a second side pocket being positioned between the central pocket and the second end of the belt;

the second side pocket being defined by a fourth stitch line positioned between the second central side pocket stitch line and the second end of the belt; and the second side pocket having an inside and outside with a second side pocket opening at the top of the belt;

the front panel having a second front belt flap integrally formed with the front panel;

the rear panel having a second rear belt flap integrally formed with the rear panel; and the second front belt flap and the second rear belt flap being joined together and folded into the inside of the second side pocket such that they extend from the top of the belt toward and to or past the central axis, whereby both the second front belt flap and the second rear flap line the inside of the opening of the second side pocket.

10. The belt of claim 9, wherein:

the closure comprises a zipper.

11. The belt of claim 9 wherein:

the front panel comprises a first front belt flap and the rear panel comprises a first rear belt flap;

the first front belt flap being integrally formed with the front panel and the first rear belt flap being integrally formed with the rear panel;

the first front belt flap and the first rear belt flap being joined together and folded into an interior space between the front panel and the rear panel such that the first front belt flap and the first rear belt flap extend from the top of the belt toward the bottom of the belt, and to or past the central axis, wherein both the first front belt flap and first rear belt flap line the inside of the opening of the first side pocket.

12. The belt of claim 11 wherein the first front belt flap and the first rear belt flap are sandwiched between the front and rear panels by the third side pocket stitch line, the third side pocket stitch line passing through the front panel, the rear panel, the first front belt flap, and the first rear belt flap.

13. The belt of claim 9 wherein:

the first front belt flap and the first rear belt flap are sandwiched between the front panel and the rear panel by the third side pocket stitch line; and the second front belt flap and the second rear belt flap are sandwiched between the front panel and the rear panel by the fourth side pocket stitch line.

* * * * *